United States Patent [19]

Westerman

[11] Patent Number: 4,819,574

[45] Date of Patent: Apr. 11, 1989

[54] RUDDERLESS SAILBOAT

[76] Inventor: Charles W. Westerman, 24446 Peacock St., El Toro, Calif. 92630

[21] Appl. No.: 40,994

[22] Filed: Apr. 21, 1987

[51] Int. Cl.[4] ..... B63H 9/04

[52] U.S. Cl. ..... 114/39.1; 114/89; 114/102

[58] Field of Search ..... 114/39, 56, 102, 103, 114/109–115, 89, 90, 97, 100, 101

[56] References Cited

U.S. PATENT DOCUMENTS

| | | | |
|---|---|---|---|
| 2,893,339 | 7/1959 | Ram | 114/39 |
| 3,223,065 | 12/1965 | Wilson | 114/39 |
| 3,304,899 | 2/1967 | Weatherly | 114/39 |
| 3,336,890 | 8/1967 | Laurent | 114/39 |
| 3,985,090 | 10/1976 | Rineman | 114/39 |
| 4,432,298 | 2/1984 | Cudmore | 114/39 |
| 4,503,795 | 3/1985 | Krans | 114/39 |

*Primary Examiner*—Sherman D. Basinger
*Assistant Examiner*—Stephen P. Avila

[57] ABSTRACT

This specification discloses a rudderless sailing craft with two sails of approximately equal area and a vertical keel affixed to the hull near a balance point between the two sails. The central part of the craft between the two sails serves as an unobstructed cockpit area free of overhead sails and swinging booms. The craft is steered by controlling both sails simultaneously from the cockpit area using a mechanism consisting of either a single rope rigged to both sails or a steering wheel and gearbox with chain-drives which rotate the booms at the base of each sail. For steering, the mechanism differentially alters the trim angle of the two sails causing the force exerted by the wind to increase on one sail and to decrease on the other sail. The hydrodynamic force on the keel acts as a fulcrum about which the differential forces exerted by the sails provide the turning moment necessary for steering the craft. For changing coarse heading or adjusting the angle of heel, the mechanism trims the sails in unison.

5 Claims, 6 Drawing Sheets

RUDDERLESS SAILBOAT

BACKGROUND OF THE INVENTION

1. Field of the Invention

This invention relates to sailing craft and particularly to sailing craft used for sport or pleasure.

2. Prior Art

Examples of unique sailing craft used for sport and pleasure are the catamaran and the sailboard. The catamaran is enjoyed for its speed relative to the great majority of other sailing craft. The sailboard offers a unique and different method of sailing which has great appeal to many water oriented sportsmen. The rudderless sailboat offers yet another choice for the sport-minded sailor. While the sailboard also uses a rudderless method of sailing, it is somewhat difficult to master and requires physical stamina and a good sense of balance. By contrast, the rudderless sailboat is very easy to master, requires very little effort to operate and can be enjoyed without getting wet.

Steering a sailboat without the aid of a rudder is not a new concept. The sailboard and all multi-masted craft are capable of being steered by their sails alone. In cases where the rudders of multi-masted craft have been damaged, the skipper's only means of steerage has been by properly trimming the sails to alter the balance between the aerodynamic and hydrodynamic forces. The sailboard likewise alters the balance between the aerodynamic and hydrodynamic forces by pivoting a single sail forward or backward over the center of lateral resistance of the keel. Prior art multi-masted craft were not designed specifically to be steered solely by trimming the sails; thus, response is sluggish since the sails must be trimmed one at a time. This invention solves the sluggish response problem by coupling both sails to a single steering device which operates the sails differentially, quickly generating a large turning moment. Experience gained sailing a 16-foot model of the rudderless sailboat revealed its high degree of maneuverability and its capability of establishing coarse headings on all points of sail.

SUMMARY OF THE INVENTION

In accordance with an embodiment of this invention, a sailing craft having no rudder is steered by coupling two sails of approximately equal area to a single device used for simultaneously controlling the trim angle of the two sails. A slender vertical keel located approximately midway between the two sails serves as a fulcrum about which the aerodynamic forces of the sails produce turning moments which can be unbalanced by the steering device to turn the craft in either direction or balanced by the steering device to hold the craft on a given coarse heading.

BRIEF DESCRIPTION OF THE DRAWINGS

FIG. 3(*b*) is a plan view of the craft of FIG. 1 showing the sails trimmed for producing a counterclockwise turning moment.

FIG. 6(*b*) is a plan view of the gears of FIG. 6(*a*) showing a slotted gear which limits the angle of attack differential of the two sails in accordance with an embodiment of the invention.

DETAILED DESCRIPTION OF THE INVENTION

Figure 1:
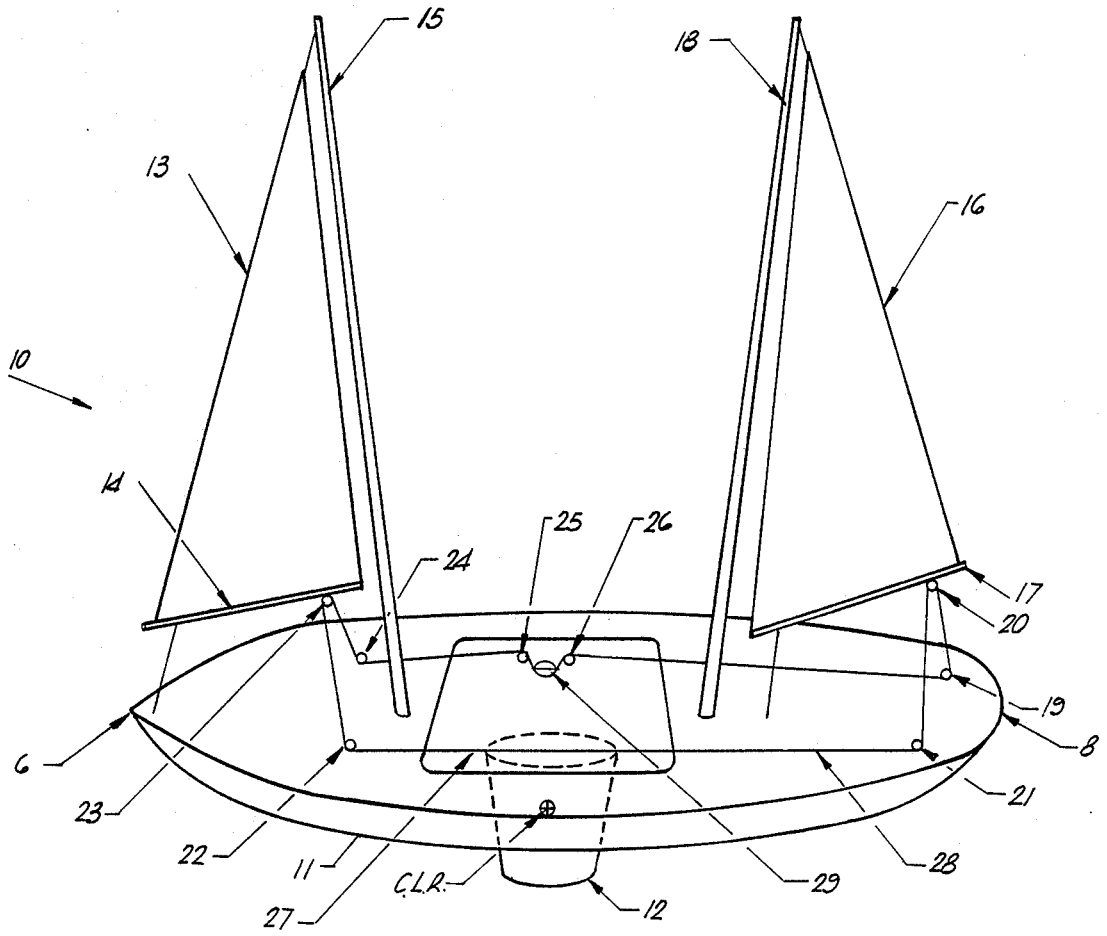
FIG. 1 is a profile view of a two-masted sailing craft steered using a single rope to control the two sails in accordance with the preferred embodiment of the invention.

Referring to FIG. 1, sailing craft 10 includes a fore sail 13 supported by fore mast 15, an aft sail 16 supported by aft mast 18, steering rope 28 and a keel 12 attached to hull 11 near a balance point between sails 13 and 16. Hull 11 and keel 12 are designed to offer a minimum of hydrodynamic resistance to yawing motion so that aerodynamic forces can control yaw stability. Mast 15 is stepped in hull 11 just forward of cockpit area 27 and leans forward toward the bow 6 of sailing craft 10. Mast 18 is stepped in hull 11 just aft of cockpit area 27 and leans aft toward the stern 8 of sailing craft 10. Cockpit area 27 is free of overhead sails and swinging booms. Sailing craft 10 has no rudder, but instead, is steered with a device capable of rotating sails 13 and 16 either differentially or in unison. When rotated differentially, a turning moment is developed about keel 12 due to the difference in aerodynamic forces on sails 13 and 16. The sails are rotated in unison to change the coarse heading or angle of heel.

Figure 2:
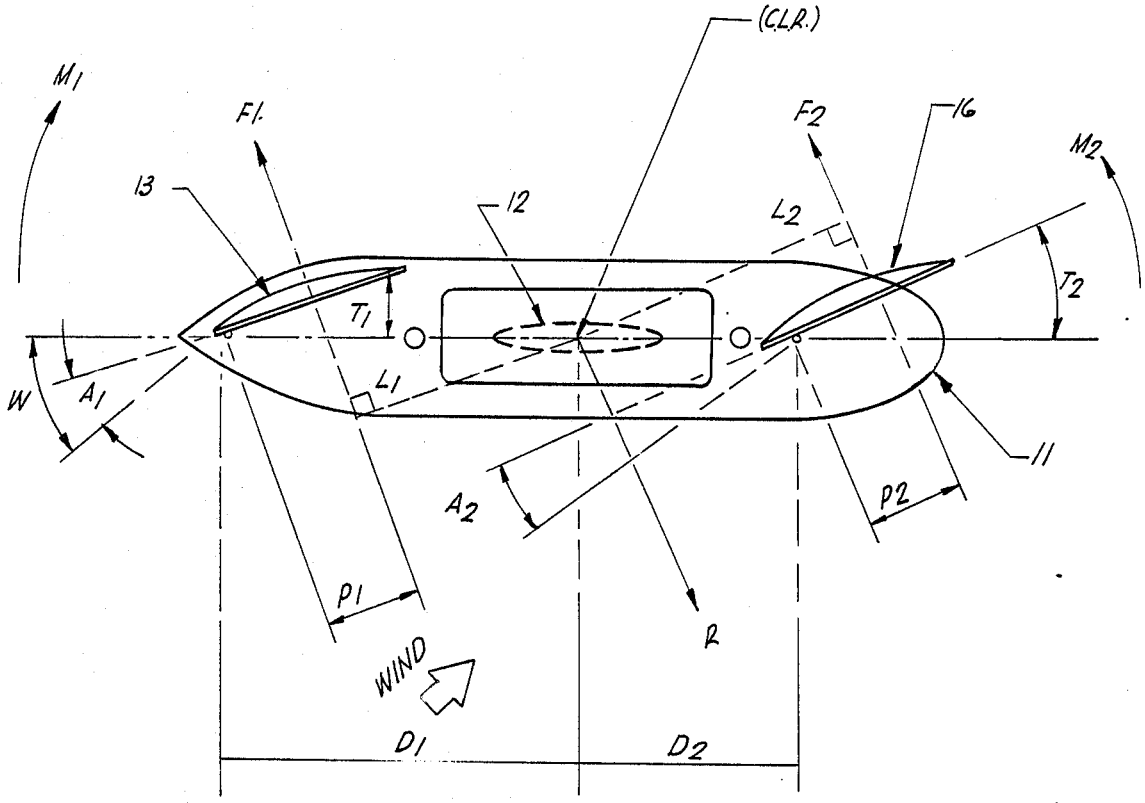
FIG. 2 is a plan view of the craft of FIG. 1 defining the turning moments M1 & M2 and the geometric relation between the keel and sails in accordance with an embodiment of the invention.

Referring to FIG. 2, clockwise moment M1 is developed by aerodynamic force F1 acting on lever arm L1 and counterclockwise moment M2 is developed by aerodynamic force F2 acting on lever arm L2, where lever arm L1 is the perpendicular distance between the line of action of aerodynamic force F1 and the center of lateral resistance (C.L.R.) of keel 12 and lever arm L2 is the perpendicular distance between the line of action of aerodynamic force F2 and the C.L.R. of keel 12. Expressed mathematically, the turning moment M is $$M=M1=M2=L1\times F1-L2\times F2 \quad (1)$$

also, for small angles of attack and sails of equal area $$M=K\times(L1\times A1-L2\times A2)\ \text{TM} \quad (2)$$

where K=A proportionally constant

A1=W−T1=Angle of attack of sail 13

A2=W−T2=Angle of attack of sail 16

The approximate mathematical expressions for lever arms L1 and L2 with craft 10 sailing upright are $$L1=D1\times\cos(T1)-P1 \quad (3)$$

$$L2=D2\times\cos(T2)+P2 \quad (4)$$

where

D1=Distance between pivot point of boom 14 and C.L.R. of keel 12

D2=Distance between pivot point of boom 17 and C.L.R. of keel 12

T1=Trim angle of sail 13=Angle between boom 14 and centerline of hull 11

T2=Trim angle of sail 16=Angle between boom 17 and centerline of hull 11

P1 & P2=The perpendicular distances between the aerodynamic force vectors F1 & F2 and the pivot points on booms 14 & 17 respectively.

Equation (2) can be used to demonstrate that craft 10 will hold to a stable course with respect to the wind (M=0) when lever arm L1 is shorter that lever arm L2. This condition is the most effective when sailing on-the-wind with trim angle T1 of sail 13 smaller than trim angle T2 of sail 16 or with craft 10 heeled over by the wind.

Equations (3) & (4) in conjunction with equation (2) show that the location of keel 12 and the location of the pivot points on booms 14 & 17 are critical to achieving the maximum driving force on sails 13 & 16. For example, with booms 14 & 17 pivoted near their forward ends greater performance is achieved if the keel is moved farther aft as the coarse heading moves farther off-the-wind. With booms 14 & 17 pivoted near their centers, however, good performance is achieved on all coarse headings without moving the keel location. If sails 13 & 16 have unequal areas the keel location must move toward the sail having the larger area.

In accordance with the preferred embodiment of this invention shown in FIG. 1, fore sail 13 and aft sail 16 are rigged with a single rope 28 used for steering. Beginning with pulley 19 at the stern of craft 10, rope 28 passes in succession through pulleys 20, 21, 22, 23 and 24. The ends of rope 28 are then passed through pulleys 25 and 26 and secured together to cleat 29 within cockpit area 27. Pulley 20 is fastened to boom 17 at the base of aft sail 16, pulleys 19 and 21 are fastened to hull 11 near the stern of craft 10, pulleys 22 and 24 are fastened to hull 11 just forward of fore mast 15 and pulley 23 is fastened to boom 14 at the base of fore sail 13. The aerodynamic forces developed by sails 13 and 16 place rope 28 in tension but with minimal net force in either direction. Steering, therefore, requires only enough pulling force on rope 28 to develop an aerodynamic force differential between sails 13 and 16 large enough to turn craft 10 at the desired rate.

Figure 3A:
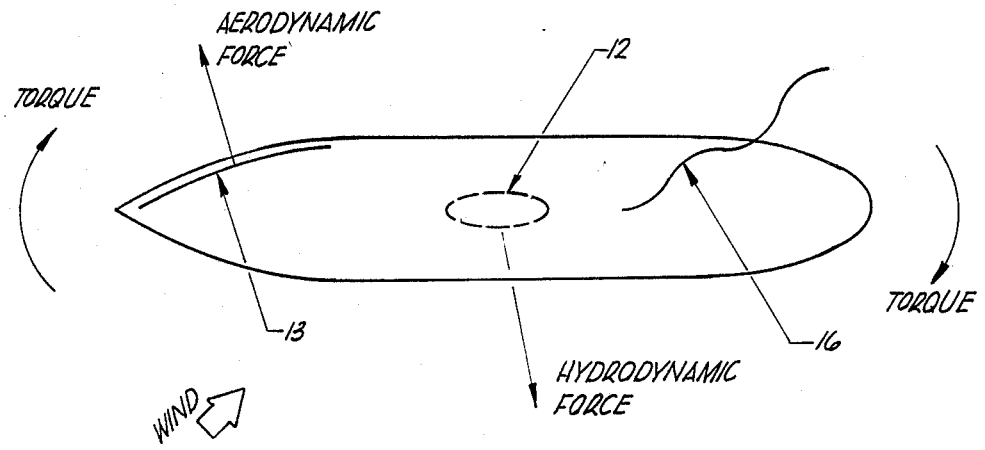
FIG. 3(*a*) is a plan view of the craft of FIG. 1 showing the sails trimmed for producing a clockwise turning moment.
Figure 3B:
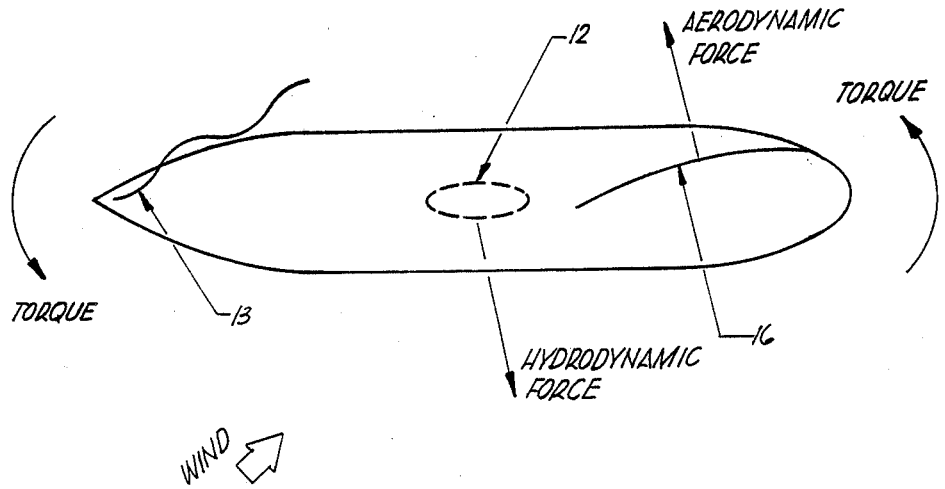

To steer away from the direction of the wind, rope 28 is pulled in the direction from bow to stern which decreases the trim angle T1 of boom 14 causing fore sail 13 to catch more wind. Simultaneously, boom 17 becomes free to swing away from hull 11 increasing trim angle T2 and causing aft sail 16 to spill its wind. The torque developed as a result of the aerodynamic force on fore sail 13 and the hydrodynamic force on keel 12 causes the bow of craft 10 to turn away from the direction of the wind as shown in FIG. 3(*a*).

To steer toward the direction of the wind, rope 28 is pulled in the direction from stern to bow which decreases the trim angle T2 of boom 17 causing aft sail 16 to catch more wind. Simultaneously, boom 14 becomes free to swing away from hull 11 increasing trim angle T1 and causing fore sail 13 to spill its wind. The torque developed as a result of the aerodynamic force on aft sail 16 and the hydrodynamic force on keel 12 causes craft 10 to turn toward the direction of the wind as shown in FIG. 3(*b*).

To change the coarse heading with respect to the wind or adjust the angle of heel, the ends of rope 28 are released temporarily from cleat 29 allowing booms 14 and 17 to swing in or out together by pulling-in or easing both ends of rope 28. After completing the adjustment, rope 28 is again secured to cleat 29 and steering is resumed using that part of rope 28 between pulleys 21 and 22.

Figure 4:
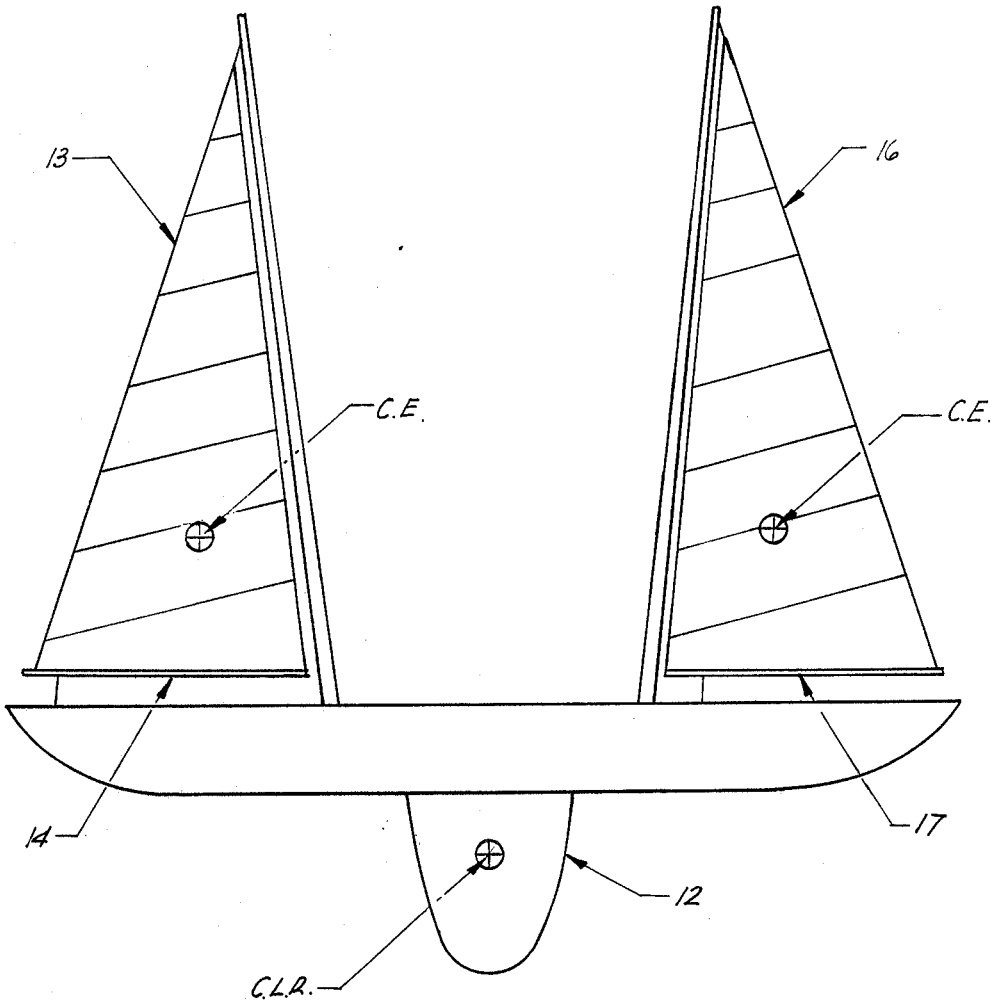
FIG. 4 is a profile view of a two-masted sailing craft with the sails pivoted about their centers of effort for achieving maximum speed in accordance with another embodiment of the invention.

In another embodiment of the invention placing emphasis on achieving maximum speed, the pivot points of booms 14 and 17 have been moved from a position near their forward ends to a position near thier middles as shown in FIG. 4. This change places the centers of effort (C.E.) of sails 13 and 16 more nearly over the pivot points so both sails can be trimmed more efficiently for all points of sail without altering the keel position. With the pivot points near the C.E., the sails cannot be adequately controlled by a simple rope and tackle system.

Figure 5:
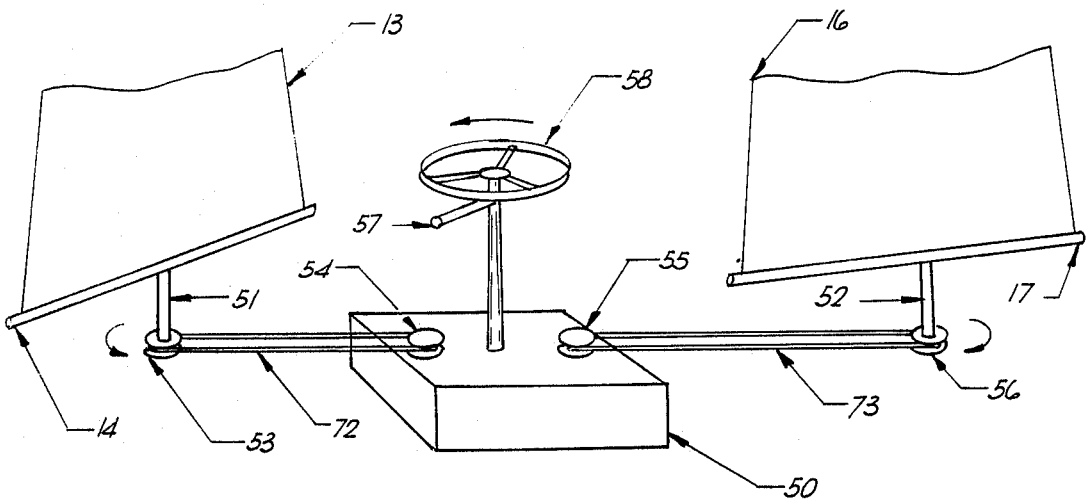
FIG. 5 is a partial overhead view of the craft of FIG. 4 showing an alternate method of controlling the sail trim using a steering wheel, gearbox and chain-drives.

Referring to FIG. 5, an alternate sail-controlling device includes gearbox 50, steering wheel 58, shift lever 57, drive chains 72 & 73 and sprockets 53, 54, 55 & 56. Spindle 51 attaches to sprocket 53 and to the pivot point on boom 14. Spindle 52 attaches to sprocket 56 and to the pivot point on boom 17. Spindles 51 and 52 are supported in bearings (not shown) attached to hull 11. Drive chains 72 & 73 transmit the rotational motion of steering wheel 58 to booms 14 and 17 using gearbox 50 and shift lever 57.

Figure 6A:
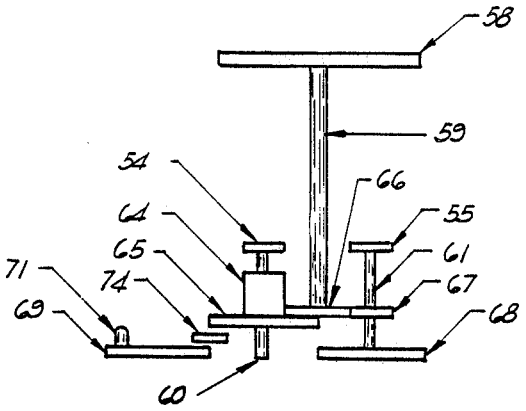
FIG. 6(*a*) is a profile view of the gears inside the gearbox shown in FIG. 5.
Figure 6B:
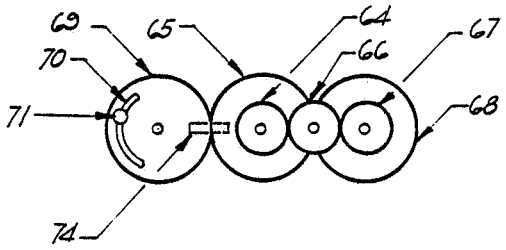

Referring to FIG. 6(*a*), the function of gearbox 50 is to control the direction of rotation of shafts 60 & 61 attached to sprockets 54 & 55 which in turn control the direction of rotation of booms 14 & 17. Gears 64 & 65 contained in gearbox 50 slide as a unit along splined-shaft 60 and are placed in three (3) separate positions by shift lever 57 using a standard linkage (not shown to retain clarity). All other gears and sprockets are pinned to their respective shafts. Gears 64 & 65 are shown in position one which is the top-most position along splined-shaft 60. Position one (1), used when making changes in coarse heading or adjusting the angle of heel, engages gears 64 & 67 through drive gear 66 causing shafts 60 & 61 to rotate in the same direction. Position two (2), used to take advantage of the self steering feature of craft 10, engages gear 65 with tooth 74 (anchored to the casing of gearbox 50) while double-width gear 64 remains engaged with gear 66 locking shafts 60 & 61 to hold the trim angles of sails 13 and 16 at fixed settings. Positions three (3), used when steering along a given coarse heading, engages gears 65 and 68 causing shafts 60 & 61 to rotate in opposite directions.

Referring to FIG. 6(*b*), the purpose of slotted gear 69 is to limit the amount of differential rotation of booms 14 & 17. When engaged with gear 65 (shift lever in position three) the rotation of gear 69 is limited by pin 71 anchored to the case of gearbox 50 and riding inside slot 70. When disengaged from gear 65, the rotational position of gear 69 is held by friction so the difference in the angular trim T1 and T2 of booms 14 & 17 is "remembered" by gear 69 until its next engagement with gear 65. Tooth 74 serves also as an alignment guide to prevent premature rotation of gear 69 before full engagement with gear 65.

Other variations and modifications of the methods described here for steering craft 10 by controlling sails 13 & 16 will no doubt occur to those skilled in the various art to which this invention pertains. All sailing craft rigged so the trim angles of the fore sail and aft sail are controlled simultaneously with a single device for the purpose of steering without the aid of a hydrodynamic rudder are considered to be within the scope of this invention. For example, additional pulleys not shown in FIG. 1 could be added to gain a greater mechanical advantage or to accomodate sails of unequal area. Also, some of the pulleys could be placed on a common spindle or arranged in a slightly different manner than disclosed here. In FIG. 5, substitutions could be made for the sprockets and chain drives used to control the sails. These substitutions might including belts and pulleys, hydraulic or electric drives, or servomechanisms. The use of a microprocessor controller might also be considered as a substitute for the steering wheel. In FIG. 6, other reversing gear arrangements are possible as are gear ratios, gear types and numbers of gears to achieve a desired mechanical advantage or to accomodate sails of unequal area. These variations and all variations which basically rely on the teachings through which this disclosure has advanced the art are properly considered within the scope of this invention.

I claim:

1. A sailing craft comprising:

a hull offering a minimum of hydrodynamic resistance to yawing motion of said sailing craft thereby allowing aerodynamic forces to control yaw stability said hull having a bow, a stern, a cockpit area located approximately midway between the bow and the stern, a fore deck located intermediate the cockpit area and the bow, and an aft deck located intermediate the cockpit area and the stern;

a first sail supported by a forward-leaning first mast stepped in a forward position of said hull for transforming the action of the wind into a driving force acting at the forward end of said hull;

a second sail supported by an aft-leaning second mast stepped in an aft position of said hull for transforming the action of the wind into a driving force acting at the aft end of said hull;

a keel attached to said hull at a balance point between said first and second sails for producing a hydrodynamic side-force thereby acting as fulcrum;

a steering means consisting of a single continuous rope passing from a cleat near said cockpit area through one side of an adjacent double block to the fore deck, there forming a first tackle between the fore deck and the end of a boom at the foot of said first sail, thence passing across said cockpit area and forming a second tackle between the aft deck and the end of a boom at the foot of said second sail, thence back through the second pulley of said double block and then secured to said adjacent cleat whereby with the ends of said rope uncleated and handled together as one rope the sails can be trimmed in unison to alter the coarse heading or adjust the angle of heel and with the ends cleated that part of said rope passing across said cockpit area between said first and second tackles is used to trim the sails differentially for steering said sailing craft onto a desired coarse heading; and said first and second sails producing forces both for driving the craft forward through the water and for developing moments about said keel for steering said sailing craft.

2. A sailing craft as recited in claim 1 wherein said keel is divided into at least two parts, said parts each occupying a separate longitudinal station between the centers of effort of said first and second sails, the depth of penetration into the water of each of said parts being adjustable for the purpose of improving the directional balance of said sailing craft while under way.

3. A sailing craft comprising:

a hull offering a minimum of hydrodynamic resistance to yawing motion of said sailing craft thereby allowing aerodynamic forces to control yaw stability said hull having a bow, a stern, a cockpit area located approximately midway between the bow and the stern, a fore deck located intermediate the cockpit area and the bow, and an aft deck located intermediate the cockpit area and the stern;

a first sail connected at its upper end to a forward-leaning first mast stepped aft of said first sail and connected at its lower end to a first boom, said first boom being substantially parallel to and pivotally attached to said fore deck of said hull, said pivotal attachment being joined to said first boom at a point between its middle and its forward end;

a second sail connected at its upper end to an aft-leaning second mast stepped forward of said second sail and connected at its lower end to a second boom, said second boom being substantially parallel to and pivotally attached to said aft deck of said hull, said pivotal attachment being joined to said second boom at a point between its middle and its forward end;

a keel attached to said hull at a balance point between said first and second sails for producing a hydrodynamic side-force thereby acting as fulcrum;

a steering means consisting of a single continuous rope passing from a cleat near said cockpit area through one side of an adjacent double block to the fore deck, there forming a first tackle between the fore deck and the end of the boom at the foot of said first sail, thence passing across said cockpit area and forming a second tackle between the aft deck and the end of the boom at the foot of said second sail, thence back through the second pulley of said double block and then secured to said adjacent cleat; and said first and second sails producing forces both for driving the craft forward through the water and for developing moments about said keel for steering said sailing craft.

4. A sailing craft comprising:

a hull offering a minimum of hydrodynamic resistance to yawing motion of said sailing craft thereby allowing aerodynamic forces to control yaw stability said hull having a bow, a stern, a cockpit area located approximately midway between the bow and the stern, a fore deck located intermediate the cockpit area and the bow, and an aft deck located intermediate the cockpit area and the stern;

a first sail connected at its upper end to a forward-leaning first mast stepped aft of said first sail and connected at its lower end to a first boom, said first boom being substantially parallel to and pivotally attached to said fore deck of said hull, said pivotal attachment being joined approximately at the middle of said first boom;

a second sail connected at its upper end to an aft-leaning second mast stepped forward of said second sail and connected at its lower end to a second boom, said second boom being substantially parallel to and pivotally attached to said aft deck of said hull, said pivotal attachment being joined at the middle of said second boom;

a steering means which includes a reversing gearbox, said gearbox being equipped with a shift lever, an input shaft and two output shafts, a steering wheel affixed to said input shaft, and sprockets afixed to each of said output shafts;

additional sprockets afixed to spindles near the mid-points on said first and second booms and chain drives for transfering the rotational motion of said gearbox to said first and second booms said gearbox having a memory gear for limiting the angular rotation differential of said first and second sails; and said first and second sails producing forces both for driving the craft forward through the water and for developing moments about said keel for steering said sailing craft.

5. A sailing craft as recited in claim 2 wherein said first and second sails are isosceles triangles.

* * * * *